United States Patent [19]

Lindeberg

[11] 3,993,883

[45] Nov. 23, 1976

[54] CONTACT SPRING SET

[75] Inventor: Sven-Erik Lindeberg, Huddinge, Sweden

[73] Assignee: Telefonaktiebolaget L M Ericsson, Stockholm, Sweden

[22] Filed: Mar. 19, 1975

[21] Appl. No.: 559,745

[30] Foreign Application Priority Data

Apr. 8, 1974 Sweden ..... 7404713

[52] U.S. Cl. ..... 200/283; 200/1 A

[51] Int. Cl.[2] ..... H01H 1/28

[58] Field of Search ..... 200/283, 271, 272, 275, 200/282, 284, 246, 1 A

[56] References Cited

UNITED STATES PATENTS

| | | | |
|---|---|---|---|
| 3,096,422 | 7/1963 | Alexandersson et al. | 200/283 |
| 3,555,228 | 1/1971 | Ohno | 200/283 |

*Primary Examiner*—Herman J. Hohauser

*Attorney, Agent, or Firm*—Hane, Baxley & Spiecens

[57] ABSTRACT

The present invention relates to a contact spring set comprising contact springs and a lifting card, attached at the outer ends of the contact springs between an upper return spring and a lower return spring. In order to achieve a playless fixing of the lifting card to at least one of the return springs, which allows for a simple fitting of the lifting card, the return spring is flat and provided with two pairs of tabs, which are bent in such a way that adjacent tabs point in opposite directions. The lifting card has a hole for the return spring which is constituted by two portions, substantially equal and displaced relative to a symmetry line through the center of the lifting card, which is perpendicular to the plane of the return spring. The contour of each hole portion has at least one straight side, these straight sides being parallel and having a distance corresponding to the thickness of the return spring and a combined overall length corresponding to the width of the return spring. The remainder of the contours allows the first pair of tabs to pass through freely but, when pushing the card further on, the return spring is forced to twist to allow the second pair of tabs to pass the hole. After completed passage of the tabs the spring flips back and locks in the hole with a tight fit.

1 Claim, 3 Drawing Figures

CONTACT SPRING SET

Figure 1:
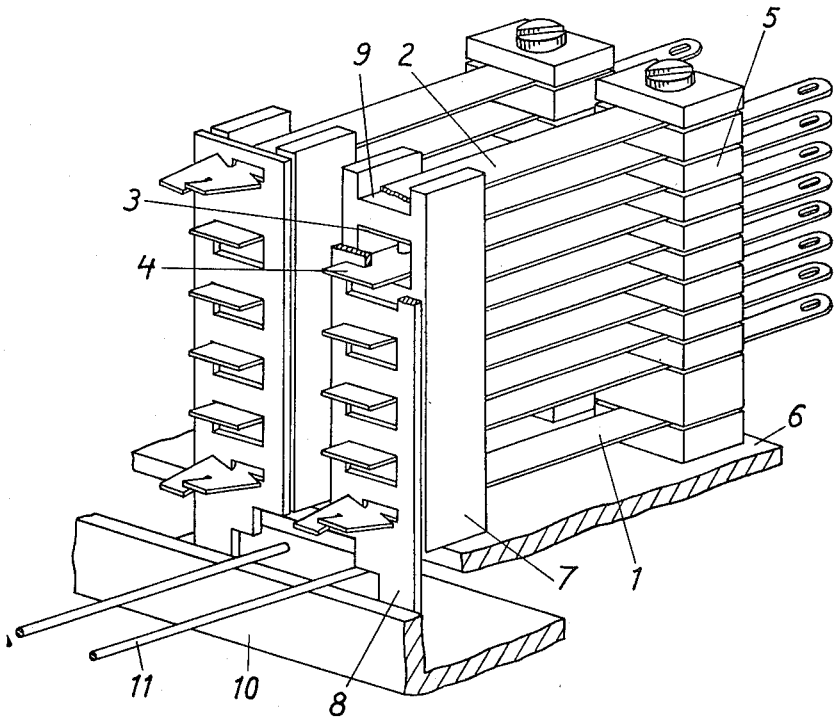

The present invention relates to a contact spring set comprising contact springs and a lifting card, attached at the outer ends of the contact springs between an upper return spring mounted above the contact springs and a lower return spring mounted underneath the contact springs, and a method for manufacturing the contact spring set when included in a unit comprising a number of spring sets side by side, for example a bridge multiple in a crossbar selector.

In certain applications, for example crossbar selector multiples, the mechanical system (selector bridge) must, owing to tolerances, be given a certain excess motion to ensure complete contact functions in the activated contact spring sets. In this connection the commonly preferred embodiment utilizes so called indirect action, which means that the moving contact springs strive to make contact with the fixed springs, but in the rest condition they are held back by the lifting card as a result of counteracting spring forces. On activating the spring set this counteraction is overcome, the lifting card allowing the moving springs to make contact with the fixed ones. At rest, consequently, the end positions of the moving springs are determined by the lifting card and in the activated condition by the fixed springs. It is necessary, therefore, to arrange a stop for the lifting card in the rest condition, which is appropriately related to the fixed springs of the contact spring set, in order that the travel distance between the respective end positions is kept within the desired tolerance limits.

An obvious solution is to arrange an end stop for the lifting card, against which it will hit when returning to the rest position. However, as the same end of the lifting card also constitutes the actuation point for the bridge, mechanical design drawbacks are inherent which generally imply added unit size in the lifting direction. It is furthermore difficult to mechanically relate the end stop directly to the spring set, and hence consideration must be taken to unfavourable tolerance combinations between the construction elements concerned.

A better basic principle is to let the return movement of the lifting card be stopped by the same mechanical element as the one which determines the positions of the fixed springs. This element may, for example, be constituted by a pillar shaped block provided with openings, in which the fixed springs are held in place by spring pressure against the appropriate opening surfaces, while the moving springs can move in the respective openings under control of the lifting card. According to the prerequisite stated in the introduction, the lifting rib is attached between a lower and an upper return spring and in such case it may seem convenient to achieve the desired stop in such manner, for example, that the upper return spring is made to hit the top end of the pillar shaped block. However, this presupposes that the lifting card is so attached that no loose movements occur as a result of the mass forces which affect the lifting card, and that, for manufacturing cost reasons, the fitting of the lifting card will be simple to carry out. One way to meet these requirements is to let the return springs act against each other in cup shaped notches in each end of the lifting card, the resultant of the counteracting spring forces being large enough to bring the moving contact springs to the rest position.

The drawback with such a solution is, however, that the upper return spring alone is charged with not only the force from the lower return spring, but also with the forces obtained from all the moving springs, which act in the same direction. As a consequence of this, rather a hard material must be chosen for the upper return spring, which makes the manufacturing of this detail more expensive. For this reason, consequently, it is desirable that the return springs are made to cooperate, given equal shares of the required spring force. While maintaining the principle that the lifting card is to be held in position by counteracting spring forces one finds, however, that it is difficult to achieve an adequate balance between the spring forces in order to obtain the required force distribution during different phases of operation and at the same time to allow a certain decrease of the contact spring forces. The reason is that, according to the prerequisite, the combined spring force of the two return springs must outweigh the total force of the moving contact springs, but the force of the lower return spring must not be so large that, together with the mass forces, it overcomes the spring forces of the contact springs when the upper return spring hits the stop. To get away from these contradictory demands it is necessary to attach at least the upper return spring in such manner that the forces which act upon the lifting card can be transferred to the return spring without loose movements independent of the direction of the forces.

The purpose of the present invention is to achieve a playless fixing of the lifting card to at least one of the return springs, for example the upper one, thus enabling the two return springs to cooperate, at the same time simplifying the fitting of the lifting card on the springs. This is achieved in such manner that the return spring in question is flat, its outer end being provided with a pair of guide tabs, which are bent in opposite directions, and behind them, a pair of lock tabs, which are bent in opposite directions relative to each other and relative to each of the guide tabs, the lifting card having a fixing hole, intended for the return spring, which is so shaped that it can be easely slipped over the guide tabs of the spring, but when being pushed further on to the spring forces the latter to twist to an angel corresponding to the bending of the lock tabs and then, after complete passage of the lock tabs, twist back into its original plane, the spring now contacting the surfaces of the fixing hole edges.

The characteristics of the invention appear from the claims.

Figure 2:
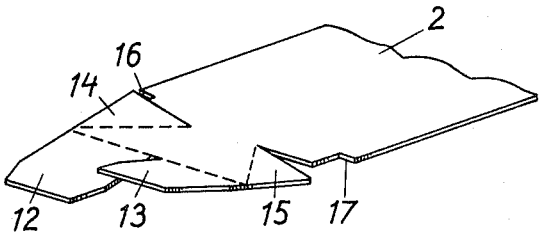
Figure 3:
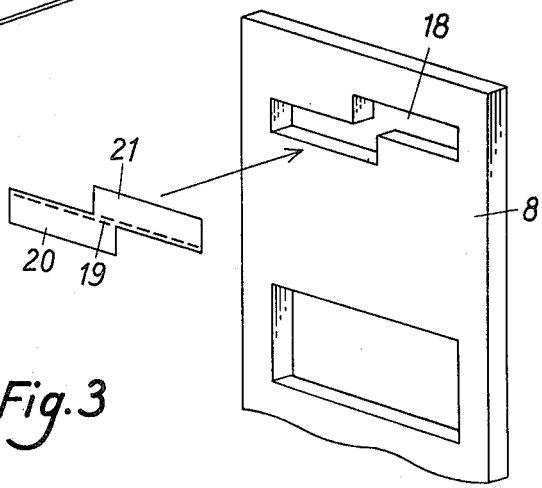

In the following description of an embodiment of the invention reference is made to the enclosed drawing, where FIG. 1 shows two contact spring sets with lifting arrangements, which can be actuated by a selector bridge, FIG. 2 shows the way tabs can be arranged in a return spring, and FIG. 3 shows how the corresponding fixing hole in the lifting card can be shaped.

According to the example in FIG. 1 each of the contact spring sets comprises a lower return spring 1, and upper return spring 2, a number of fixed contact springs, for example 3, and a corresponding number of moving contact springs, for example 4, which by means of separators, for example 5, are fixed to a base plate 6. On the same base plate are also mounted pillar shaped blocks 7, one for each of the contact groups, provided with openings for the springs. The fixed springs press against the upper surfaces of the respective openings. The moving springs are stressed in the direction towards the fixed springs, but are governed by a lifting card 8, which in the rest position of the spring set keeps the springs separated. The force required for this is obtained from said upper and lower return springs, which act upon the lifting card in opposite direction to the moving contact springs. The rest position is in this manner determined by contact of the upper return spring against the bottom surface 9 of the cut out in the block 7, made for the upper return spring. For the sake of clarity the lifting card and the upper return spring have been cut in the Fig. According to the example, the spring set is actuated by means of a bridge 10 and a selector wire 11. In this manner the lifting card is lifted by the bridge through mediation of the selector wire, so that the moving contact springs can make contact with the fixed contact springs. As appears from the Fig. there is a considerable play for the moving springs in the lifting card which allows the latter to continue its movement a bit further, after that the contacts have closed. When returning to its rest position, the lifting card again catches the moving springs and finally is stopped in its movement when the upper return spring hits the surface 9. It is important, then, that the fixing of the return spring is playless as otherwise the dynamic force of the moving system would cause function disturbing mechanical oscillations.

To obtain the desired playless fixing of for example the upper return spring to the lifting card the end of the spring and the fixing hole in the lifting card, respectively, may be shaped in accordance with FIGS. 2 and 3. According to FIG. 2 the spring 2, which is a flat spring, is in its end provided with four bent tabs, a front pair 12, 13 and a rear pair 14, 15. The bending directions are opposite for adjacent tabs, in which manner the edge line, which connects a front tab, for example 13, with a rear tab, for example 15, will be in the main straight and form an angel with the plane of the spring. According to the Fig. the spring has furthermore been provided with a pair of shoulders 16, 17. The fixing hole 18 in the lifting card 8 for the return spring appears from FIG. 3. For the sake of clarity the shape of the hole has been shown in a projection at the side of the lifting card and can be described as being composed of three parts. The hole is thus constituted by a rectangular slot 19, which has the short side equal to the thickness of the spring, and two, according to the example rectangular, extensions 20, 21 which are placed diametrically in relation to the center of the slot and overlap each other. The width of the fixing hole, i.e. the largest size of the slot shaped part, corresponds to the width of the spring, in front of said shoulders 16, 17. In the Fig. is also shown the hole in the lifting card for actuation of the uppermost moving contact spring; the rest of the card is cut away.

When fitting the lifting card, it is pushed over all springs, i.e. all moving contact springs and upper and lower return springs. The above described embodiment of for example the upper return spring and the fixing hole in the lifting card makes it possible for the front pair of tabs to easily pass into the fixing hole to such a depth that the side edge lines of the tabs hit the long sides of the slot. During the continued passage through the hole the spring is forced to twist around its longitudinal axis, because of the contact of the side edge lines against said long sides, in which manner the flat portion of the spring, following the rear tabs, can enter into the hole. After complete passage of the rear tabs the spring flips back to its original plane, contact being obtained between the flat surfaces of the spring and the inner surfaces of the slot. Further displacement of the lifting card is prevented by the two shoulders 16, 17, which are located behind the rear tabs on a distance corresponding to the thickness of the lifting card.

From the above description it appears that the slot in the lifting card can be given such a thickness that a tight fit is obtained against the spring without making the mounting of the lifting card difficult. The arrangement is particularly suited for efficient fitting of lifting cards on spring set multiples, in which case all lifting cards belonging to a multiple can be put together into a sheet which is pushed over all springs simultaneously, after which the individual cards are cut apart.

We claim:

1. Contact spring set comprising contact springs and a lifting card attached at the outer ends of the contact springs between an upper return spring mounted above the contact springs and a lower return spring mounted underneath the contact springs, characterized in that, to obtain playless fixing of the lifting card (8), at least one of the return springs is flat, the outer end of said return spring (2) having two pairs of tabs (12, 13, 14, 15), one pair behind the other in the longitudinal direction of the spring, said tabs being punched and bent in such manner that adjacent tabs have opposite bending directions, said lifting card (8) having a hole intended for the fixing of the return spring (2), which hole is constituted by a rectangular slot (19) corresponding to the cross section of said return spring and two extensions (20, 21), diametrically placed in relation to the center of the hole, which extensions allow the front pair of tabs (12, 13) to enter into the hole of the lifting card when the flat portion of the spring is aligned with said rectangular slot, and, when the rear pair of tabs (14, 15) is pushed through the hole, force the return spring to twist around the longitudinal axis and, after completed passage of the rear pair of tabs, flip back to a position where the flat surfaces of the spring are in contact with the edge surfaces of said rectangular slot.

* * * * *